US012458112B2

(12) United States Patent
Siegismund et al.

(10) Patent No.: US 12,458,112 B2
(45) Date of Patent: Nov. 4, 2025

(54) ARTICLE OF FOOTWEAR HAVING A CLOSURE SYSTEM

(71) Applicant: PUMA SE, Herzogenaurach (DE)

(72) Inventors: Andreas Siegismund, Rueckersdorf (DE); Reinhold Sussmann, Scheinfeld (DE); Romain Girard, Lauf an der Pegnitz (DE)

(73) Assignee: PUMA SE, Herzegenaurach (DE)

( * ) Notice: Subject to any disclaimer, the term of this patent is extended or adjusted under 35 U.S.C. 154(b) by 25 days.

(21) Appl. No.: 18/092,574

(22) Filed: Jan. 3, 2023

(65) Prior Publication Data

US 2023/0210220 A1 Jul. 6, 2023

Related U.S. Application Data

(60) Provisional application No. 63/295,983, filed on Jan. 3, 2022.

(51) Int. Cl.

| | |
|---|---|
| ***A43C 11/00*** | (2006.01) |
| ***A43C 11/16*** | (2006.01) |
| ***A43C 11/22*** | (2006.01) |

(52) U.S. Cl.

CPC ..... *A43C 11/22* (2013.01); *A43C 11/008* (2013.01); *A43C 11/165* (2013.01)

(58) Field of Classification Search

CPC ..... A43C 1/00; A43C 1/003; A43C 1/006; A43C 7/00; A43C 11/008; A43C 11/165

See application file for complete search history.

(56) References Cited

U.S. PATENT DOCUMENTS

| | | | | |
|---|---|---|---|---|
| 5,463,822 | A * | 11/1995 | Miller | A43C 11/00 36/50.1 |
| 7,490,417 | B2 * | 2/2009 | Petrie | A43C 11/20 36/170 |
| 2012/0079741 | A1 * | 4/2012 | Kohatsu | A43C 11/008 36/50.1 |
| 2013/0008057 | A1 * | 1/2013 | Bird | A43C 11/008 36/131 |
| 2014/0338223 | A1 * | 11/2014 | Adams | A43C 1/003 36/50.1 |
| 2017/0332734 | A1 * | 11/2017 | Orand | A43B 13/04 |
| 2018/0160775 | A1 * | 6/2018 | Pollack | B65H 75/4449 |
| 2019/0208863 | A1 * | 7/2019 | Adams | A43C 11/20 |
| 2020/0390196 | A1 | 12/2020 | Manzato | |
| 2021/0093046 | A1 * | 4/2021 | Lam | A43C 1/06 |

(Continued)

FOREIGN PATENT DOCUMENTS

| | | | |
|---|---|---|---|
| EP | 3192386 | A1 | 7/2017 |
| WO | 2017066415 | A1 | 4/2017 |

OTHER PUBLICATIONS

International Search Report and Written Opinion of International Application No. PCT/IB2023/050029, dated Mar. 2, 2023, 15 pages.

*Primary Examiner* — Sharon M Prange

(74) *Attorney, Agent, or Firm* — Quarles & Brady LLP

(57) ABSTRACT

A closure system for an article of footwear includes a closure mechanism, a securing element, and a cord that is configured to be operably engaged with an upper of the footwear. The closure mechanism is configured to be actuated to adjust the footwear from a loosened configuration to a tightened configuration, and the securing element is configured to be engaged with the closure mechanism to secure the footwear in the tightened configuration.

12 Claims, 6 Drawing Sheets

(56) References Cited

U.S. PATENT DOCUMENTS

| | | | | |
|---|---|---|---|---|
| 2021/0368946 | A1 | 12/2021 | Aoki | |
| 2022/0193490 | A1* | 6/2022 | Ghiotto | A43B 3/40 |
| 2022/0225736 | A1* | 7/2022 | Kagami | A43C 1/00 |
| 2023/0248116 | A1* | 8/2023 | Duller | A43C 11/165 24/68 SK |

* cited by examiner

ARTICLE OF FOOTWEAR HAVING A CLOSURE SYSTEM

CROSS REFERENCE TO RELATED APPLICATIONS

This application claims the benefit of and priority to U.S. Provisional Application No. 63/295,983, filed on Jan. 3, 2022, which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a fastening system or closure system.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear having uppers with an increased comfort and better fit are desired, along with improved closure mechanisms.

SUMMARY

An article of footwear, as described herein, may have various configurations. The article of footwear may have an upper and a sole structure connected to the upper.

In one aspect, a closure system for an article of footwear includes a closure mechanism, a securing element, and a cord that is configured to be operably engaged with an upper of the footwear. The closure mechanism is configured to be actuated to adjust the footwear from a loosened configuration to a tightened configuration, and the securing element is configured to be engaged with the closure mechanism to secure the footwear in the tightened configuration.

In some embodiments, the closure mechanism is mounted to the upper on a lateral side of the footwear within a heel region. The cord is operably engaged with the closure mechanism and extends through a winding region proximate a tongue of the footwear. In some embodiments, the securing element is a strap having a receptacle defined by a securing surface, the securing surface being configured to be removably engaged with the closure mechanism. Further, the securing element extends across the upper from a medial side to the lateral side of the footwear. In some embodiments, the securing element is configured to at least partially conceal the cord. In one particular embodiment, the securing element is formed of an elastic material and attached to a sole of the footwear at a fixed end.

In another aspect, a closure system for an article of footwear includes a closure mechanism, a securing element, and a cord that is operably coupled to an upper and the closure mechanism. The securing element includes a first segment and a second segment that overlaps the first segment, and the closure mechanism is configured to be actuated to tighten and loosen the footwear.

In some embodiments, the second segment of the securing element includes a free end that is configured to be articulated between an unfastened position and a fastened position. Further, the second segment of the securing element is removably engaged with the closure mechanism in the fastened position, and the second segment is spaced apart from the closure mechanism in the unfastened position. Additionally, the first segment of the securing element is engaged with the closure mechanism in both the fastened position and the unfastened position. In some embodiments, the closure mechanism is disposed centrally on the upper and proximate a tongue of the footwear. In some embodiments, the cord is laced through a plurality of eyelets on the upper and at least partially concealed by the securing element.

In still another aspect, a closure system for an article of footwear includes a strap having a first segment and a second segment, a band, and a plurality of retention features arranged on an upper. The band is coupled to at least one of the retention features and to the strap, and wherein the second segment of the strap is configured to be pulled to tighten the footwear.

In some embodiments, the second segment of the strap is configured to be removably fastened to the first segment of the strap. The strap is wrapped around a heel end of the upper and extends from a lateral side to a medial side. In some instances, the first segment of the strap includes a pulley attached to a first end, the second segment of the strap includes a free end, and pulling the free end of the strap causes the first end of the strap to slide along the upper. Further, pulling the free end of the strap exerts a tensional force on the band, and wherein the band exerts a tensional force on the upper. In some embodiments, the band is formed of an elastic material. In some embodiments, user may adjust a tightness of the footwear by adjusting the band relative to the retention features, the strap, or both Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
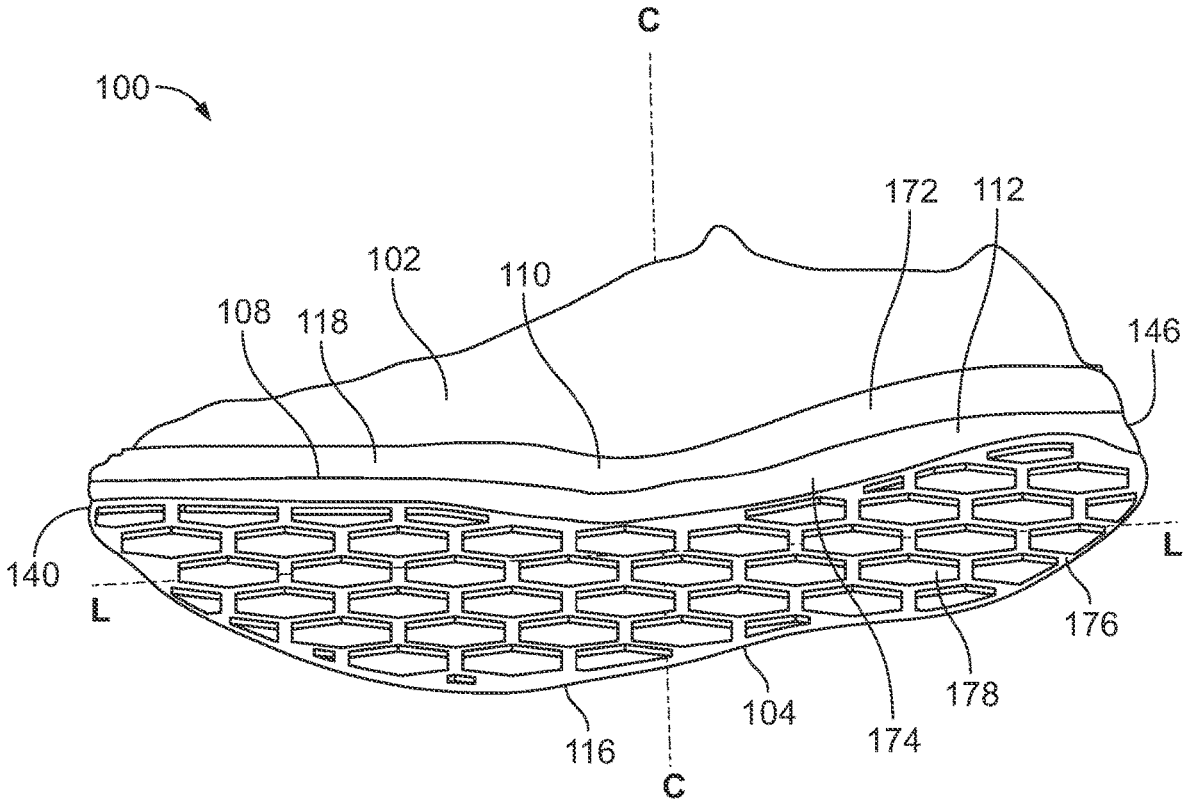
FIG. 1 is a perspective view of a bottom and medial side of an article of footwear configured as a right shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
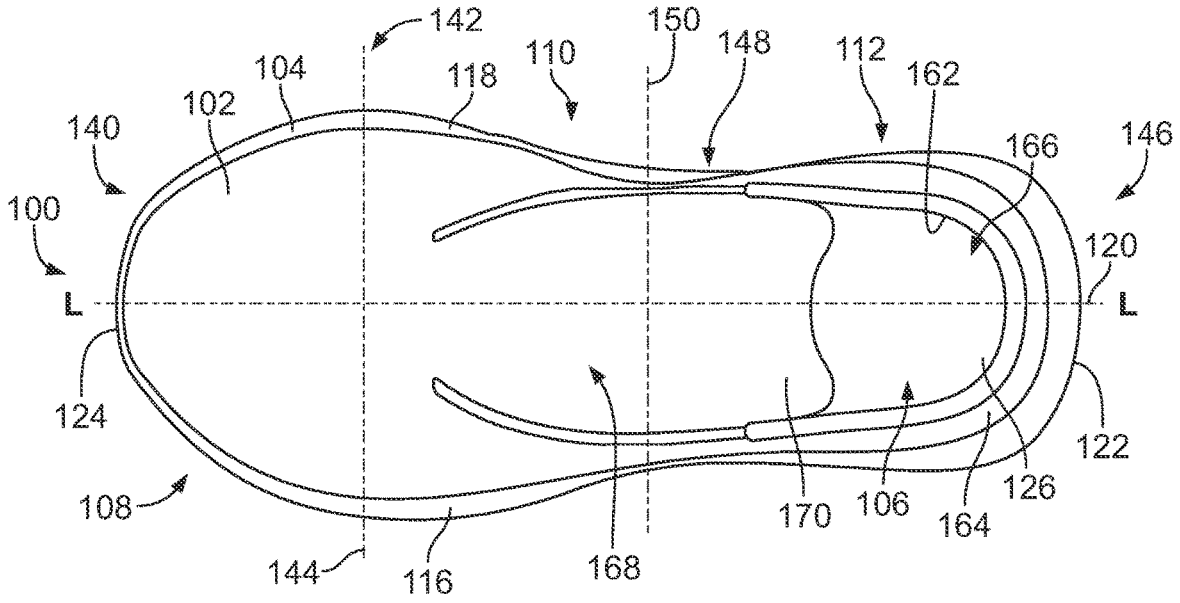
FIG. 2 is a top view of the article of footwear of FIG. 1.
Figure 3:
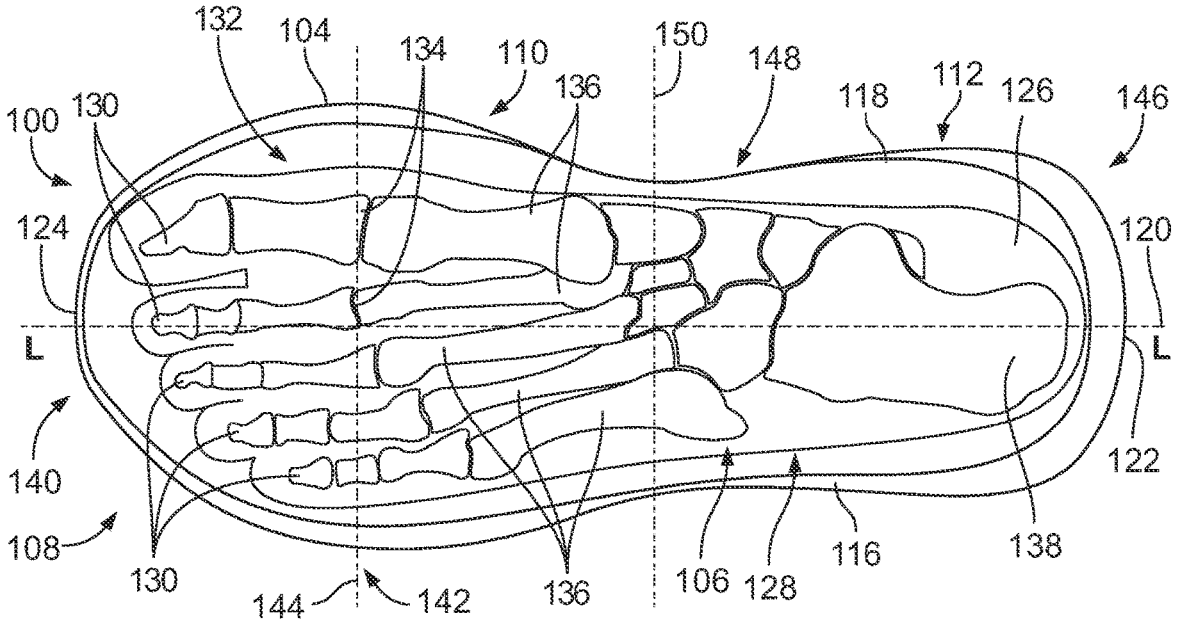
FIG. 3 is a top plan view of the article of footwear of FIG. 1, with an upper removed and a user's skeletal foot structure overlaid thereon.

FIGS. 1-3 depict an exemplary embodiment of an article of footwear 100 including an upper 102 and a sole structure 104. The upper 102 is attached to the sole structure 104 and together define an interior cavity 106 (see FIGS. 2 and 3) into which a foot may be inserted. For reference, the article of footwear 100 defines a forefoot region 108, a midfoot region 110, and a heel region 112 (see FIGS. 2 and 3). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements, e.g., textiles, polymer foam, polymer sheets, leather, and synthetic leather, which are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

With reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

Referring again to FIG. 1, the sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Furthermore, the insole can be positioned within the interior cavity 106 of the upper 102, which can be in direct contact with a user's foot while an article of footwear 100 is being worn. Moreover, the upper 102 may also include a liner (not shown) that can increase comfort, for example, by reducing friction between the foot of the user and the upper 102, the sole 104, the insole, or the like, and/or by providing moisture wicking properties. The liner may line the entirety of the interior cavity 106 or only a portion thereof. In some embodiments, a binding (not shown) may surround an opening of the interior cavity 106 to secure the liner to the upper 102 and/or to provide an aesthetic element on the article of footwear 100.

Referring to FIGS. 2 and 3, the article of footwear 100 also defines a lateral side 116 and a medial side 118. When a user is wearing the shoes, the lateral side 116 corresponds with an outside-facing portion of the article of footwear 100 while the medial side 118 corresponds with an inside-facing portion of the article of footwear 100. As such, the article of footwear 100 has opposing lateral sides 116 and medial sides 118. The medial side 118 and the lateral side 116 adjoin one another along a longitudinal central plane or axis 120 of the article of footwear 100, which is coplanar with the longitudinal axis L of FIG. 1. As will be further discussed herein, the longitudinal central plane or axis 120 may demarcate a central, intermediate axis between the medial side 118 and the lateral side 116 of the article of footwear 100. Put differently, the longitudinal plane or axis 120 may extend between a rear, proximal end 122 of the article of footwear 100 and a front, distal end 124 of the article of footwear 100 and may continuously define a middle of an insole 126, the sole structure 104, and/or the upper 102 of the article of footwear 100, i.e., the longitudinal plane or axis 120 is a straight axis extending through the rear, proximal end 122 of the heel region 112 to the front, distal end 124 of the forefoot region 108.

Unless otherwise specified, and referring to FIGS. 2 and 3, the article of footwear 100 may be defined by the forefoot region 108, the midfoot region 110, and the heel region 112. The forefoot region 108 may generally correspond with portions of the article of footwear 100 that encase portions of a foot 128 that include the toes or phalanges 130, the ball of the foot 132, and one or more of the joints 134 that connect the metatarsals 136 of the foot 128 with the toes or phalanges 130. The midfoot region 110 is proximate and adjoins the forefoot region 108. The midfoot region 110 generally corresponds with portions of the article of footwear 100 that encase an arch of a foot 128, along with a bridge of the foot 128. The heel region 112 is proximate to the midfoot region 110 and adjoins the midfoot region 110. The heel region 112 generally corresponds with portions of the article of footwear 100 that encase rear portions of the foot 128, including the heel or calcaneus bone 138, the ankle (not shown), and/or the Achilles tendon (not shown).

Still referring to FIGS. 2 and 3, the forefoot region 108, the midfoot region 110, the heel region 112, the medial side 118, and the lateral side 116 are intended to define boundaries or areas of the article of footwear 100. To that end, the forefoot region 108, the midfoot region 110, the heel region 112, the medial side 118, and the lateral side 116 generally characterize sections of the article of footwear 100. Certain aspects of the disclosure may refer to portions or elements that are coextensive with one or more of the forefoot region 108, the midfoot region 110, the heel region 112, the medial side 118, and/or the lateral side 116. Further, both the upper 102 and the sole structure 104 may be characterized as having portions within the forefoot region 108, the midfoot region 110, the heel region 112, and/or along the medial side 118 and/or the lateral side 116. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 118 and/or the lateral side 116.

Still referring to FIGS. 2 and 3, the forefoot region 108, the midfoot region 110, the heel region 112, the medial side 118, and the lateral side 116 are shown in detail. The forefoot region 108 extends from a toe end 140 to a widest portion 142 of the article of footwear 100. The widest portion 142 is defined or measured along a first line 144 that is perpendicular with respect to the longitudinal axis 120 that extends from a distal portion of the toe end 140 to a distal portion of a heel end 146, which is opposite the toe end 140. The midfoot region 110 extends from the widest portion 142 to a thinnest portion 148 of the article of footwear 100. The thinnest portion 148 of the article of footwear 100 is defined as the thinnest portion of the article of footwear 100 measured across a second line 150 that is perpendicular with respect to the longitudinal axis 120. The heel region 112 extends from the thinnest portion 148 to the heel end 146 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 118, and/or the lateral side 116 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 118, and/or the lateral side 116 discussed herein.

Still referring to FIGS. 2 and 3, the medial side 118 begins at the distal, toe end 140 and bows outward along an inner side of the article of footwear 100 along the forefoot region 108 toward the midfoot region 110. The medial side 118 reaches the first line 144, at which point the medial side 118 bows inward, toward the central, longitudinal axis 120. The medial side 118 extends from the first line 144, i.e., the widest portion 142, toward the second line 150, i.e., the thinnest portion 148, at which point the medial side 118 enters into the midfoot region 110, i.e., upon crossing the first line 144. Once reaching the second line 150, the medial side 118 bows outward, away from the longitudinal, central axis 120, at which point the medial side 118 extends into the heel region 112, i.e., upon crossing the second line 150. The medial side 118 then bows outward and then inward toward the heel end 146, and terminates at a point where the medial side 118 meets the longitudinal, central axis 120.

The lateral side 116 also begins at the distal, toe end 140 and bows outward along an outer side of the article of footwear 100 along the forefoot region 108 toward the midfoot region 110. The lateral side 116 reaches the first line 144, at which point the lateral side 116 bows inward, toward the longitudinal, central axis 120. The lateral side 116 extends from the first line 144, i.e., the widest portion 142, toward the second line 150, i.e., the thinnest portion 148, at which point the lateral side 116 enters into the midfoot region 110, i.e., upon crossing the first line 144. Once reaching the second line 150, the lateral side 116 bows outward, away from the longitudinal, central axis 120, at which point the lateral side 116 extends into the heel region 112, i.e., upon crossing the second line 150. The lateral side 116 then bows outward and then inward toward the heel end 146, and terminates at a point where the lateral side 116 meets the longitudinal, central axis 120.

Still referring to FIGS. 2 and 3, the upper 102 extends along the lateral side 116 and the medial side 118, and across the forefoot region 108, the midfoot region 110, and the heel region 112 to house and enclose a foot of a user. When fully assembled, the upper 102 also includes an interior surface 162 and an exterior surface 164. The interior surface 162 faces inward and generally defines the interior cavity 106, and the exterior surface 164 of the upper 102 faces outward and generally defines an outer perimeter or boundary of the upper 102. The upper 102 also includes an opening 166 that is at least partially located in the heel region 112 of the article of footwear 100, which provides access to the interior cavity 106 and through which a foot may be inserted and removed. In some embodiments, the upper 102 may also include an instep region 168 that extends from the opening 166 in the heel region 112 over an area corresponding to an instep of a foot to an area proximate the forefoot region 108. The instep region 168 may comprise an area similar to where a tongue 170 of the present embodiment is disposed. In some embodiments, the upper 102 does not include the tongue 170, i.e., the upper 102 is tongueless.

In the illustrated embodiment, the sole structure 104 includes a midsole 172 and an outsole 174. The outsole 174 may define a bottom end or bottom surface 176 of the sole structure 104 across the heel region 112, the midfoot region 110, and the forefoot region 108. Further, the outsole 174 may be a ground-engaging portion or include a ground-engaging surface of the sole structure 104 and may be opposite of the insole thereof. As illustrated in FIG. 1, the bottom surface 176 of the outsole 174 may include a tread pattern 178 that can include a variety of shapes and configurations. The outsole 174 may be formed from one or more materials to impart durability, wear-resistance, abrasion resistance, or traction to the sole structure 104. In some embodiments, the outsole 174 may be formed from any kind of elastomer material, e.g., rubber, including thermoset elastomers or thermoplastic elastomers, or a thermoplastic material, e.g., thermoplastic polyurethane (TPU). In some embodiments, the outsole 174 may define a shore A hardness up to 95. In addition, the outsole 174 may be manufactured by a process involving injection molding, vulcanization, printing layer by layer, i.e., additive manufacturing systems or methods, and the like.

Still referring to FIG. 1, the midsole 172 may be individually constructed from a thermoplastic material, such as polyurethane (PU), for example, and/or an ethylene-vinyl acetate (EVA), copolymers thereof, or a similar type of material. In other embodiments, the midsole 172 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 172 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 172 is manufactured by a process involving injection molding, vulcanization, printing layer by layer, i.e., additive manufacturing systems or methods, and the like.

In embodiments where the midsole 172 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 172 may be formed using alternative methods known in the art, including the use of an expansion press, an injection machine, a pellet expansion process, a cold foaming process, a compression molding technique, die cutting, or any combination thereof. For example, the midsole 172 may be formed using a process that involves an initial foaming step in which supercritical gas is used to foam a material and then compression molded or die cut to a particular shape.

Figure 4:
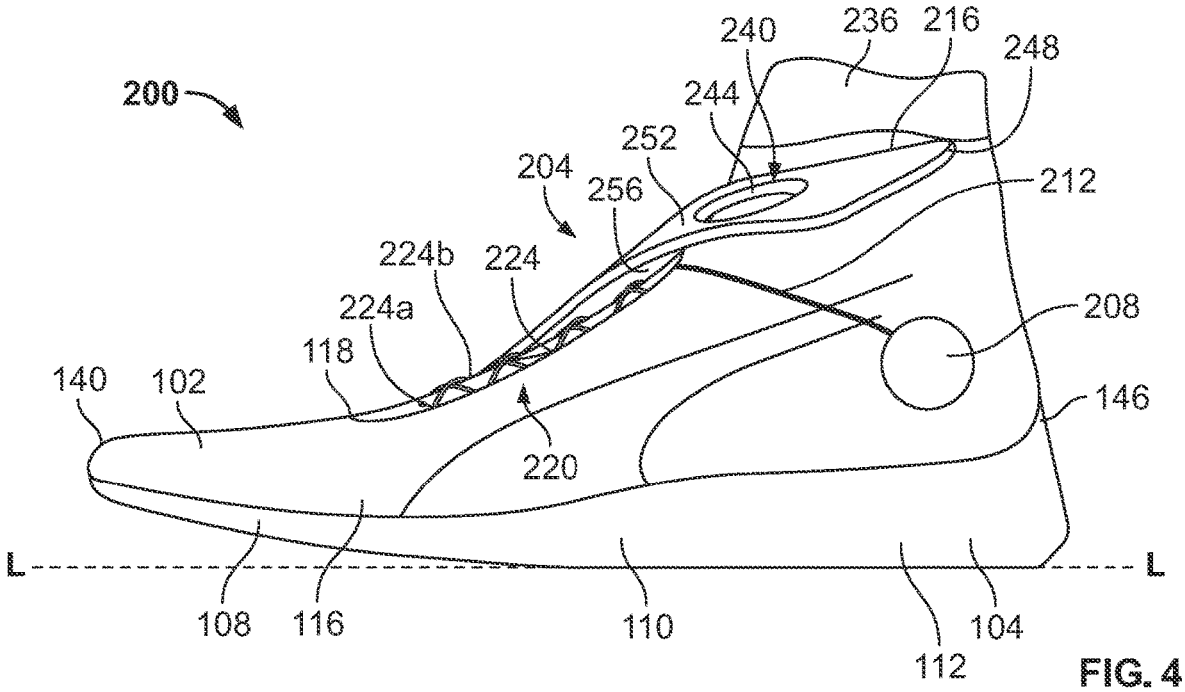
FIG. 4 is a schematic representation of a lateral side of an article of footwear configured as a left shoe in an unfastened configuration, according to an embodiment of the disclosure.
Figure 5:
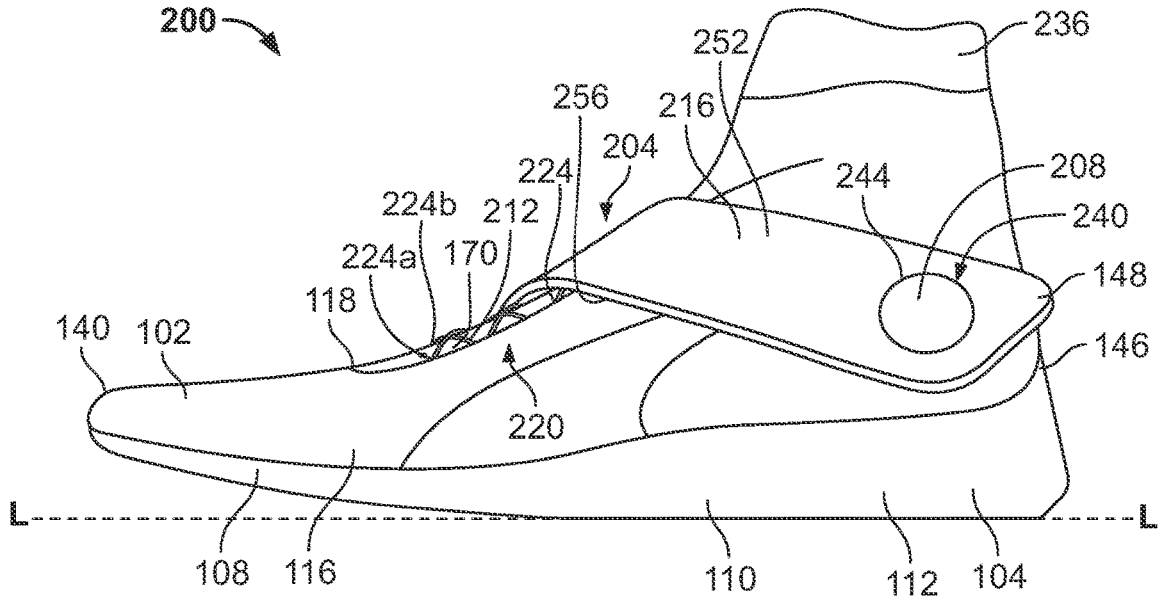
FIG. 5 is a schematic representation of the article of footwear of FIG. 4 in a fastened configuration.

FIGS. 4 and 5 depict schematic representations of an article of footwear 200 having a fastening system or closure system 204 that includes a closure mechanism 208 and a cord 212 that is operably coupled to the upper 102 and the closure mechanism 208 to tighten and/or loosen the footwear 200. Further, the closure system 204 includes a securing element 216 in the form of a strap that is configured to be removably engaged with the closure mechanism 208. When desired, a user can adjust the footwear 200 from a loosened configuration to a tightened configuration by actuating the closure mechanism 208 to apply a tensional force to the cord 212 to tighten the upper 102 and/or the sole 104 of the footwear 200 around the user's foot. Then, the user can secure the footwear 200 in the tightened configuration by articulating the strap 216 to engage the closure mechanism 208. Further, the user can adjust the footwear 200 from the tightened configuration to the loosened configuration by reversing the foregoing steps, i.e., by disengaging the strap 216 from the closure mechanism 208, and then actuating the closure mechanism 208 to loosen the cord 212 or to allow loosening of the cord 212. In this way, the closure system 204 is configured to tighten and loosen the footwear 200.

In the illustrated embodiment, the closure mechanism 208 is provided in the form of a disc-shaped rotary ratchet device mounted to the upper 102 on the lateral side of the footwear 200 and within the heel region 112. In some embodiments, the closure mechanism 208 includes a rotary ratcheting mechanism (not shown) that may be actuated by rotating a portion of the closure mechanism 208 to apply a tensional force to retrieve a length of the cord 212. Further, the ratcheting system is prevented from rotating in the reverse direction and, thus, locks into place in radial increments as the footwear is further tightened. As the cord 212 is retrieved by repeated rotations of the closure mechanism, the upper 102 becomes tightened around the user's foot within the interior cavity 106. It is also contemplated that the closure mechanism 208 may be similar to those disclosed in U.S. Pat. Nos. 5,325,613, 5,600,875, 5,606,778, 5,638,588, 5,651,198, and 5,669,116, which are all commonly assigned to Puma SE and incorporated by reference in their entirety herein. For example, it is contemplated that the closure mechanism 208 may include one or more aspects of such closure mechanisms to provide tightening or loosening functionality when mounted on the respective footwear 200 of the present disclosure.

As illustrated in FIGS. 4 and 5, the cord 212 extends from the closure mechanism 208 to a winding region 220 proximate the tongue 170 of the footwear 200, and the cord 212 is laced across the tongue 170 in an overlapping pattern formed by a plurality of eyelets 224. The plurality of eyelets 224 includes a lateral row 224*a* and a medial row 224*b* extending in a longitudinal direction, i.e., parallel with the longitudinal plane L, along the upper 102. When the closure system 204 is actuated to tighten the footwear 200, the cord 212 is retrieved from the winding region 220 into the closure mechanism 208, which causes the lateral row of eyelets 224*a* and the medial row of eyelets 224*b* inwardly relative to the longitudinal plane L and toward one another. In this way, the cord 212 and the eyelets 224 are arranged in the winding region 220 to tighten the upper 102 around the user's foot, striking a balance between comfort and grip of a user's foot in the footwear 200. It is contemplated that the cord 212 and the eyelets 224 may be arranged differently on the footwear 200 to further enhance the comfort and/or the grip, such as, e.g., by lacing the cord 212 around the heel end 146 within the heel region 112 of the upper 102, among other configurations. In the embodiment illustrated, the footwear 200 is also provided with a collar 236 formed of an elastic material that is stretched around a portion of a user's ankle, further increasing comfort and grip of the footwear 200 on the user's foot while preventing ingress of debris or precipitation into the opening 166 and the interior cavity 106.

Referring to FIGS. 4 and 5, the strap 216 includes a receptacle 240 in the form of a disc-shaped opening that is defined by securing surface 244. Further, the receptacle 240 is located between a free end 248 and a fixed end (not shown) that is located on the medial side 118 of the footwear 200. In the illustrated embodiment, the strap 216 narrows or tapers from the fixed end (not shown) to the free end 248, such that the strap 216 is narrowest at the free end 248. It is contemplated that the strap 216 is attached to the sole 104 of the footwear 200 at the fixed end (not shown), although other configurations are possible. The free end 248 of the strap 216 is configured to be articulated from an unfastened position (see FIG. 4), in which the free end 248 and the securing surface 244 are spaced apart from the closure mechanism 208, to a fastened position (see FIG. 5), in which the securing surface 244 is engaged with the closure mechanism 208 and the free end 248 is disposed near the upper 102 on the lateral side 116 of the footwear adjacent the closure mechanism 208. Additionally, the strap 216 includes an outer surface 252 that is opposite an inner surface 256, with the outer surface 252 configured to face outwardly away from the upper 102 and the inner surface 256 configured to face inwardly toward the upper 102. In the unfastened position, a portion of the inner surface 256 of the strap 216 is spaced apart from the upper 102 (see FIG. 4); and in the fastened position, the entire inner surface 256 of the strap 216 is disposed near and/or contacts the upper 102 (see FIG. 5). In addition, the toe end 140 of the footwear 200 is configured to be displaced in an upward direction, i.e., away from the longitudinal axis L, when the strap 216 is moved from the unfastened position (see FIG. 4) to the fastened position (see FIG. 5). It is also contemplated that the toe end 140 of the footwear 200 is displaced upwardly by way of the footwear 200 being adjusted into the tightened configuration.

Still referring to FIGS. 4 and 5, the strap 216 is configured to be moved from the unfastened position to the fastened position to conceal the cord 212 and to secure the closure mechanism 208. To that end, the strap 216 can be formed of any kind of resilient and flexible material, e.g., any of the woven and non-woven textiles or any of the elastomeric materials described above, which allows the strap 216 to be easily manipulated and to conform to the shape of the upper 102. Further, the securing surface 244 of the strap 216 can be adapted for releasably securing to the closure mechanism 208. For example, the securing surface 244 of the strap 216 can include a rib (not shown) projecting into the receptacle 240 for engagement with a rim (not shown) of the closure mechanism 208, such that the strap 216 can be fastened to the closure mechanism 208 in a snap-fit configuration. In some embodiments, the securing surface 244 is formed of a rigid material, e.g., compositions of thermoset elastomers or thermoplastic elastomers or thermoplastic polyurethane (TPU), among others. To that end, the securing surface 244 may be comprised of a different material than the rest of the strap 216. In some embodiments, the securing surface 244 is fitted with a plurality of ribs (not shown) or indentations (not shown) that are configured to engage with the closure mechanism 208. Accordingly, the securing surface 244 of the strap 216 is sized and shaped to correspond to the closure mechanism 208.

It is also contemplated that the upper 102 and/or the strap 216 may include fastening means, such as, e.g., hook-and-loop fasteners, a buckle, a zipper, magnetic elements, and the like, which assist in retaining the strap 216 to the upper 102 in the fastened position. In some embodiments, the strap 216 is removably fastened to the closure mechanism 208 and secures the closure mechanism 208 against rotation, thereby preventing actuation of the closure mechanism 208 to tighten and/or loosen the footwear 200. Additionally or alternatively, the strap 216 may be formed of an elastic material that biases the strap 216 away from the closure mechanism 208, such that the strap 216 is pulled across the upper 102 and stretched into the fastened position where the securing surface 244 is pressed against the closure mechanism 208 in a lateral-to-medial direction. Accordingly, the strap 216 can function as a retaining mechanism of the closure system 204.

Referring to FIG. 5, the strap 216 conceals a portion of the cord 212 and surrounds the closure mechanism 208 when moved into the fastened position. To that end, the strap 216 is formed of opaque material or translucent material to conceal underlying portions of the cord 212 and the upper 102. Further, when moved into the fastened position, the strap 216 extends across the winding region 220 to at least partially protect or shield the cord 212 and eyelets 224 from external forces and/or outdoor environments. It is contemplated that the strap 216 can be enlarged so as to cover and conceal more of the upper 102 and the winding region 220. Additionally or alternatively, the closure mechanism 208 is exposed through the receptacle 240 of the strap 216. In some instances, the closure mechanism 208 is flush with the outer surface 252 of the strap 216. In other embodiments, the closure mechanism 208 is recessed within the receptacle 240 away from outer surface 252 of the strap 216. In still other embodiments, the closure mechanism 208 protrudes outwardly of the receptacle 240 away from the outer surface 252 of the strap 216. In the fastened position, the free end 248 of the strap 216 extends heel-ward of the heel end 146 of the footwear 200, such that the free end 248 is readily grasped by a user to unfasten the strap 216 from the closure mechanism 208. In some embodiments, the free end 248 is shortened so as to be flush with or inset from the heel end 146 of the footwear 200. In other embodiments, the free end 248 may be received within a holder (not shown) in the form of a pocket or a slot or a loop provided on the upper 102, such that the free end 248 is restrained against movement until selectively and deliberately detached by the user.

Figure 6:
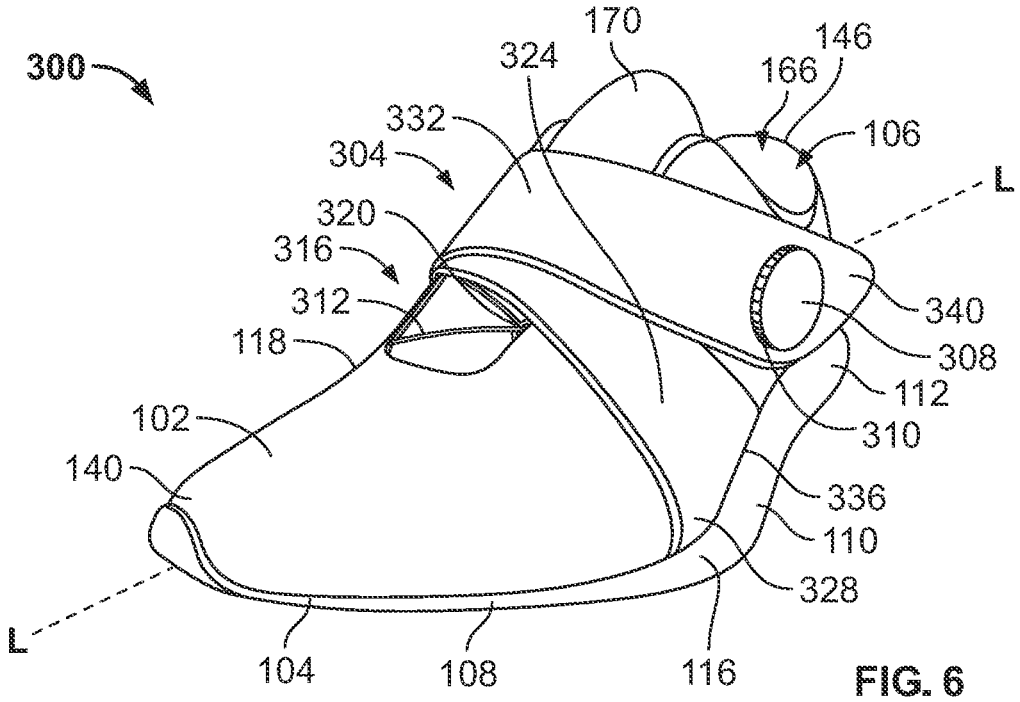
FIG. 6 is a schematic representation of a perspective view of a toe end and lateral side of another article of footwear configured as a left shoe in a fastened configuration, according to an embodiment of the disclosure.

FIG. 6 illustrates a schematic representation of another embodiment of an article of footwear 300 having a closure system 304. In the illustrated embodiment, the closure system 304 includes a closure mechanism 308 mounted to the upper 102 on the lateral side 116 and within the heel region 112. In particular, the closure mechanism 308 includes ridges 310 extending therearound and exposed for improving a user's grip while rotating the closure mechanism 308. Further, a cord 312 is operably connected to the upper 102 and the closure mechanism 308 to tighten and/or loosen the footwear 300. To that end, the cord 312 extends through a winding region 316 proximate the tongue 170 of the footwear 300 and is laced through eyelets 320 along the winding region 316 to distribute tensional forces to the upper 102 for tightening and/or loosening the footwear 300. The closure system 304 operates similarly to the closure system 204 of FIGS. 4 and 5.

Referring back to FIG. 6, the closure system 304 also includes a strap 324 that comprises a first segment 328 and a second segment 332. In the illustrated embodiments, the first segment 328 of the strap 324 extends across the upper 102 from the lateral side 116 to the medial side 118 of the footwear 300. In particular, the first segment 328 has a fixed end 336 that is permanently fastened to the upper 102 and the sole 104 on the lateral side 116 of the footwear 300. The fixed end 336 of the first segment 328 extends within the forefoot region 108 and the midfoot region 110, and the first segment 328 narrows as it extends away from the fixed end 336. The second segment 332 extends across the upper 102 from the medial side 118 to the lateral side 116 of the footwear 300. In the illustrated embodiment, the second segment 332 overlaps a portion of the first segment 328 while extending across the upper 102 to a free end 340 that is disposed on the lateral side 116 within the heel region 112. In addition, the second segment 332 of the strap 324 is removably engaged with the closure mechanism 308. In the illustrated embodiment, the first segment 328 of the strap 324 extends diagonally heel-ward and toward the medial side 118 of the footwear 300, the second segment 332 of the strap 324 extends diagonally heel-ward and toward the lateral side 116 of the footwear 300, and together the first segment 328 and the second segment 332 of the strap 324 overlap in a V-shaped formation on the lateral side 116 of the footwear 300.

It is contemplated that the strap 324 is formed of a continuous strip of material, such that the first segment 328 and the second segment 332 are monolithically formed. In other embodiments, the first segment 328 and the second segment 332 are distinct components that are attached to one another. It is contemplated that the strap 324 is formed of resilient materials, such as woven or non-woven fabric materials, elastic materials, thermoplastic materials, and the like. It is further contemplated that the first segment 328 of the strap 324 is operably coupled to the second segment 332 of the strap 324 to at least partially tighten and/or loosen the footwear 300. Still further, the strap 324 may function as a securing element for the closure mechanism 308 of the closure system 304 in a manner similar to the strap 324 of FIGS. 4 and 5. Turning back to FIG. 6, the strap 324 may be looped through a buckle (not shown) on the medial side 118 of the footwear 300, so that pulling the free end 340 of the second segment 332 applies a tensional force to the fixed end 336 of the first segment 328.

In particular embodiments, the closure mechanism 308 extends outwardly from the second segment 332 of the strap 324, so as to make the ridges 310 accessible to a user even when the second segment 332 of the strap 324 is fastened to the closure mechanism 308. It is also contemplated that the closure mechanism 308 may be similar to those disclosed in U.S. Pat. Nos. 5,325,613, 5,600,875, 5,606,778, 5,638,588, 5,651,198, and 5,669,116, which are all commonly assigned to Puma SE and incorporated by reference in their entirety herein. For example, it is contemplated that the closure mechanism 308 may include one or more aspects of such closure mechanisms to provide tightening or loosening functionality when mounted on the respective footwear 300 of the present disclosure.

Figure 7:
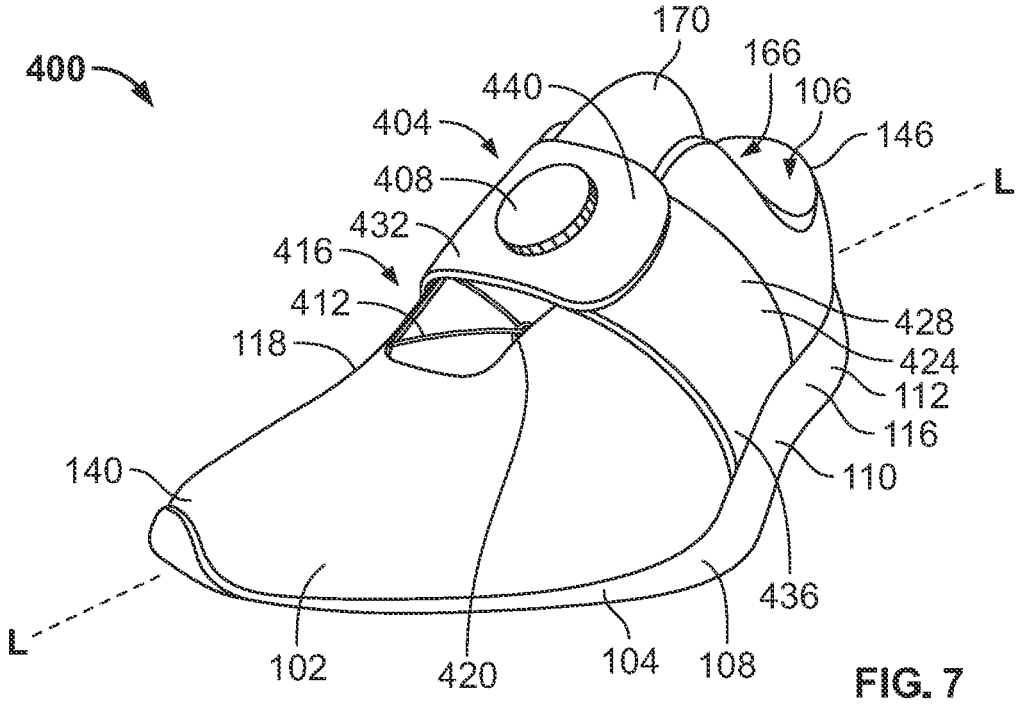
FIG. 7 is a schematic representation of a perspective view of a toe end and lateral side of yet another article of footwear configured as a left shoe in a fastened configuration, according to an embodiment of the disclosure.

FIG. 7 is a schematic representation of still another embodiment of an article of footwear 400 having a closure system 404. In the illustrated embodiment, the closure system 404 includes a closure mechanism 408 that is positioned on the upper 102 proximate the tongue 170. In particular, the closure mechanism 408 is centrally disposed between the lateral side 116 and the medial side 118 of the footwear 400 and is intersected by the longitudinal plane L. Further, a cord 412 is operably connected to the upper 102 and closure mechanism 408 to tighten and/or loosen the footwear 400. To that end, the cord 412 extends through a winding region 416 proximate the tongue 170 of the footwear 400 and is laced through eyelets 420 along the winding region 416 to distribute tensional forces to the upper 102 for tightening and/or loosening the footwear 400. The closure system 404 operates similarly to the closure system 204 of FIGS. 4 and 5.

Referring to FIG. 7, the closure system 404 also includes a strap 424 having a first segment 428 and a second segment 432 that overlaps the first segment 428 and extends across the upper 102 within the midfoot region 110 of the footwear 400. In particular, the first segment 428 extends from a fixed end 436 on the lateral side 116 toward the medial side 118, and the second segment 432 extends from the medial side 118 toward a free end 440 that is disposed on the lateral side 116. It is contemplated that the strap 424 can be made of any kind of resilient and flexible material, e.g., any of the woven and non-woven textiles or any of the elastomeric materials described above. Further, it is contemplated that the first segment 428 and the second segment 432 of the strap 424, or portions thereof, may be formed of different materials or additional materials to alter functional and/or structural aspects of the strap 424. As illustrated in FIG. 7, the second segment 432 overlaps the first segment 428 such that the free end 440 is rested on or near the first segment 428. The first segment 428 and the second segment 432 are substantially uniform in width, i.e., measured in a direction parallel to the longitudinal plane L, although other configurations are possible.

It is contemplated that both the first segment 428 and the second segment 432 of the strap 424 are removably engaged with the closure mechanism 408, such that both the first segment 428 and the second segment 432 are configured to be moved to tighten and/or loosen the footwear 400. It is further contemplated that the first segment 428 is permanently fastened to the closure mechanism 408 and the second segment 432 of the strap 424 is removably fastened to the closure mechanism 408, such that only the second segment 432 is configured to be moved to tighten and/or loosen the footwear 400. It is also contemplated that the closure mechanism 408 may be similar to those disclosed in U.S. Pat. Nos. 5,325,613, 5,600,875, 5,606,778, 5,638,588, 5,651,198, and 5,669,116, which are all commonly assigned to Puma SE and incorporated by reference in their entirety herein. For example, it is contemplated that the closure mechanism 408 may include one or more aspects of such closure mechanisms to provide tightening or loosening functionality when mounted on the respective footwear 400 of the present disclosure.

Figure 8:
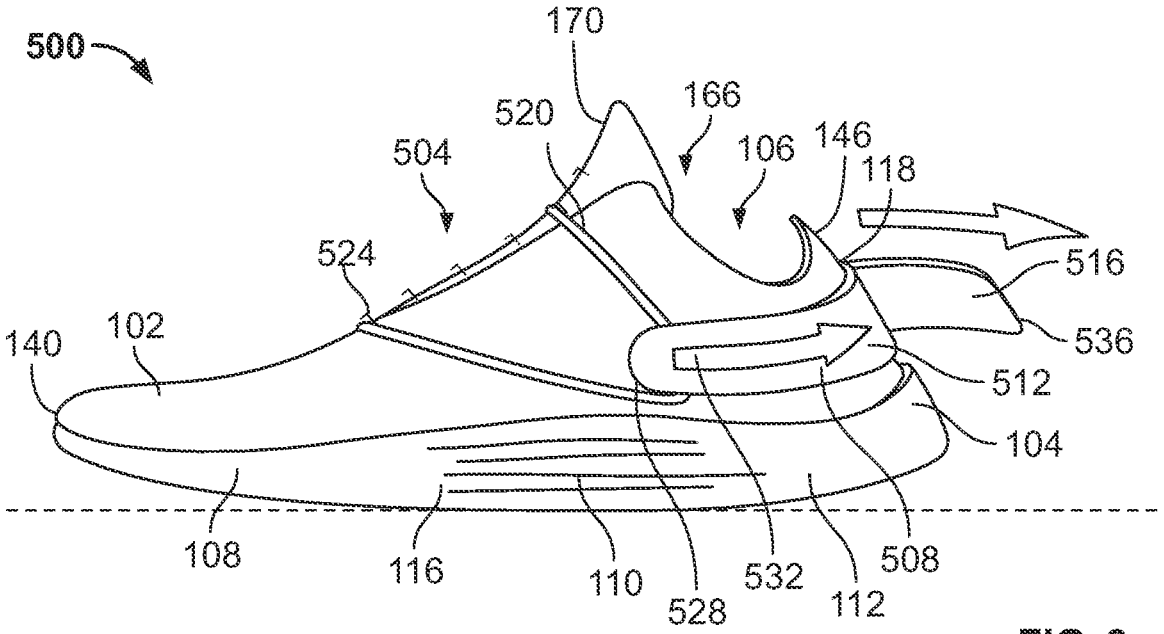
FIG. 8 is a schematic representation of a lateral side view of still another article of footwear configured as a left shoe in an unfastened configuration, according to an embodiment of the disclosure.
Figure 9:
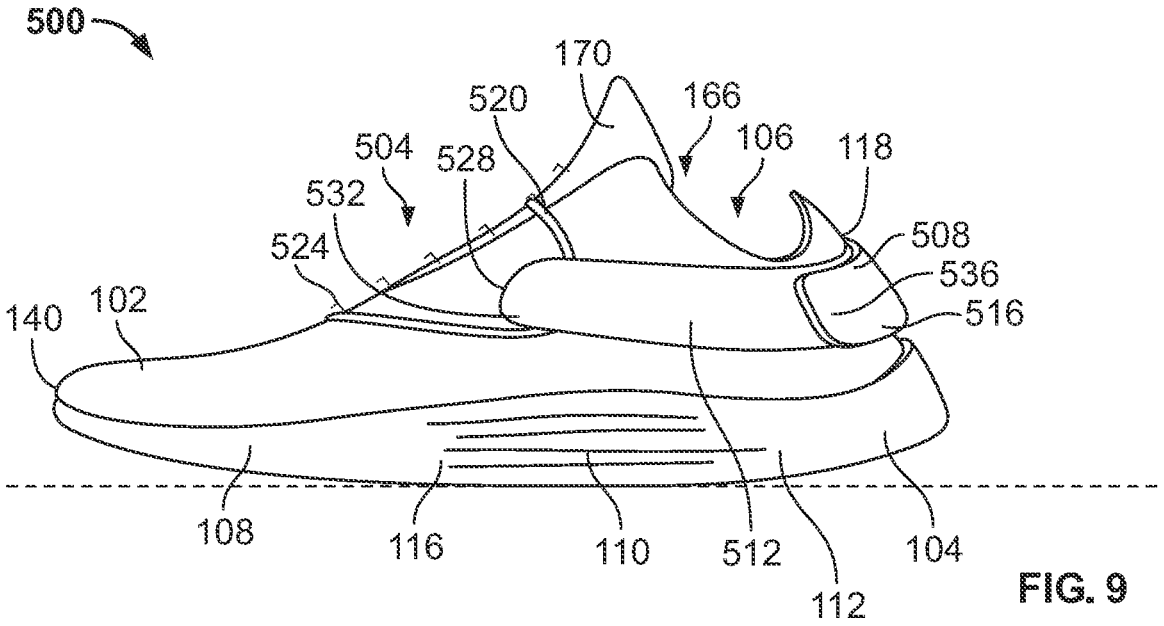
FIG. 9 is a schematic representation of the footwear of FIG. 8 in a fastened configuration.

FIGS. 8 and 9 depict a schematic representation of another embodiment of an article of footwear 500 having a closure system 504. In the illustrated embodiment, the closure system 504 includes a strap 508 having a first segment 512 and a second segment 516. Further, the closure system 504 includes a band 520 that is operably coupled to the strap 508 and extends across the upper 102. In the illustrated embodiment, the band 520 is provided as a continuous loop of elastic material, e.g., a form of rubber and/or ethylene propylene diene monomer (EPDM) material, that is retained on the tongue 170 by a plurality of retention features 524 in the form of guide projections. A plurality of guide projections 524 are arranged along the tongue 170 and configured to receive and retain a portion of the band 520.

Referring to FIG. 8, the first segment 512 of the strap 508 extends across upper 102 on the lateral side 116 of the footwear 500 and in the heel-ward direction within the heel region 112. Further, the first segment 512 of the strap 508 includes a pulley 528 at a first end 532 and wraps around the heel end 146 of the footwear 500 as it extends toward the medial side 118. The second segment 516 of the strap 508 extends across the upper 102 on the medial side 118 of the footwear 500 and in the heel-ward direction within the heel region 112. Further, the second segment 516 of the strap 508 is configured to wrap around the heel end 146 and to overlap the first segment 512 of the strap 508 so that a second end or free end 536 of the second segment 516 can be removably fastened to the first segment 512 of the strap 508. In some embodiments, the free end 536 of the second segment 516 is provided with a fastening means, such as, e.g., hook-and-loop fasteners, magnetic elements, adhesives, zippers, and the like.

As illustrated in FIGS. 8 and 9 the first segment 512 and the second segment 516 of the strap 508 are operably coupled to one another and configured to tighten and/or loosen the footwear 500. In an unfastened position depicted in FIG. 8, the free end 536 of the second segment 516 of the strap 508 is unattached to the first segment 512 and pulled rearwardly, i.e., in a direction parallel with the longitudinal plane L, of the heel end 146 to draw the pulley 528 of the first segment 512 rearward across the upper 102 within the heel region 112. Accordingly, the strap 508 and, in particular, the first end 532 of the first segment 512 is configured to slide along the upper 102 during operation of the closure system 504. Further, the pulley 528 is operably coupled to the band 520 on the lateral side 116 of the footwear 500, such that movement of the pulley 528 causes the band 520 to be stretched in the rearward direction. However, due to the elastic properties of the band 520, a biasing force is exerted on the pulley 528 in the forward direction, i.e., opposite the rearward direction.

In a fastened position depicted in FIG. 9, the free end 536 of the second segment 516 of the strap 508 is attached to the first segment 512 of the strap 508 within the heel region 112. It is contemplated that a user can adjust the tightness of the footwear 500 by varying the position at which the free end 536 of the second segment 516 is attached to the first segment 512. For example, a tightness level or fit of the footwear 500 increases as the free end 536 of the second segment 516 is attached at a point farther forwardly along the lateral side 116 and toward the pulley 528. In other words, attaching the free end 536 of the second segment 516 closer to the pulley 528 of the first segment 512 increases the tightness of the footwear 500, and vice versa.

Figure 10:
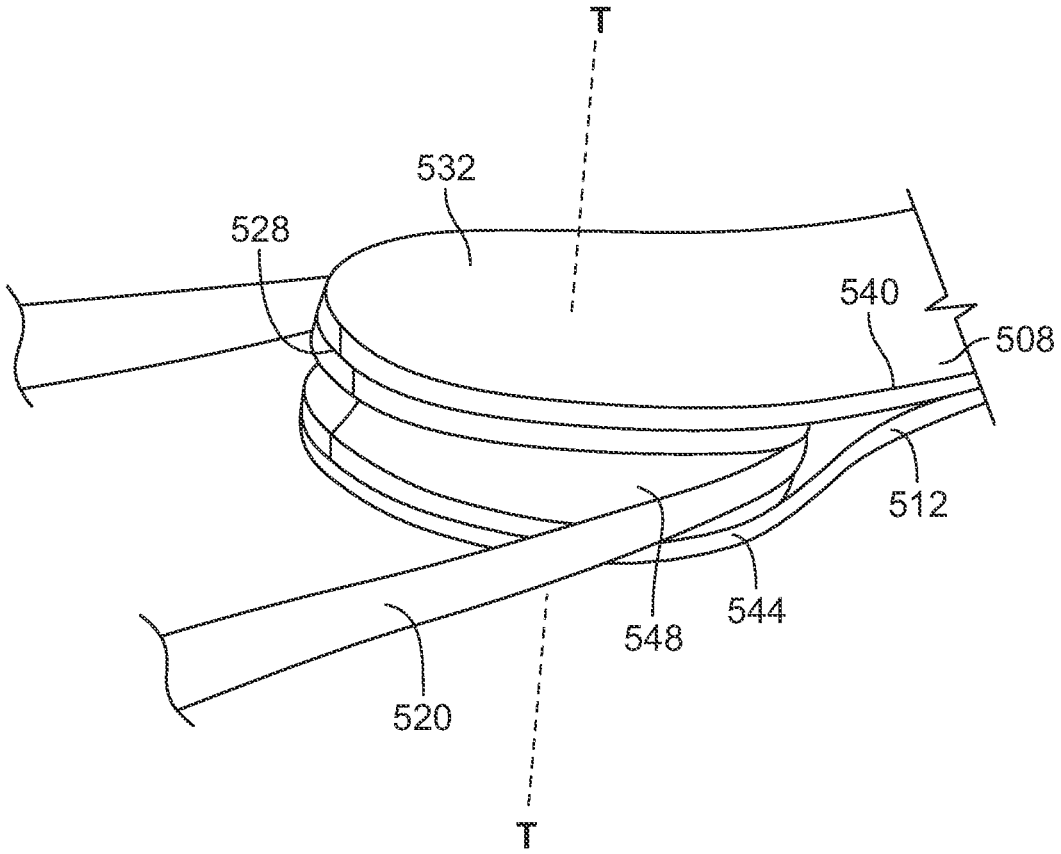
FIG. 10 is a schematic representation of a partial, perspective view of a pulley of the footwear of FIGS. 8 and 9.

FIG. 10 depicts the pulley 528 of the first end 532 of the strap 508 in detail. The pulley 528 is a disc-shaped component attached between an outer layer 540 and an inner layer 544 of the strap 508. In the illustrated embodiment, the pulley 528 includes a curved groove 548 that extends about the circumference of the pulley 528 and is configured to receive a portion of the band 520 for sliding engagement therewith. The pulley 528 defines a transverse axis T extending centrally through the pulley 528 and the first end 532 of the first segment 512 of the strap 508. It is contemplated that the pulley 528 is fixed to the first end 532 of the strap 508 and secured against rotation about the transverse axis T. Accordingly, the band 520 slides radially about the transverse axis T within the groove 548 of the pulley 528 as the closure system 504 is operated, by way of the strap 508, to tighten and/or loosen the footwear 500. In other embodiments, the pulley 528 can be rotated about the transverse axis T, such that movement of the band 520 within the groove 548 causes rotation of the pulley 528 in a clockwise or counterclockwise rotation about the axis T.

Referring back to FIG. 9, the band 520 is retained by two of the guide projections 524 on the tongue 170. It is contemplated that the band 520 can be retained by two different guide projections 524 to adjust the tightness and/or comfort of the footwear 500. For example, by retaining the band 520 at the two, adjacent forward-most guide projections 524, a user can increase the tightness of the footwear 500 by loading the pulley 528 with a maximum amount of biasing force. However, doing so concentrates the compression forces applied by the band 520 and the strap 508 in smaller areas on the user's foot, i.e., on the back of the heel and the top of the foot, which may lessen comfort for the user. In another example, by retaining the band 520 at the two, adjacent rearmost guide projections 524, a user can decrease the tightness of the footwear 500 by loading the pulley 528 with a minimal amount of biasing force. In doing so, the compression forces applied by the band are concentrated higher up on the top of the foot. In still another example, the band 520 can be retained at spaced apart guide projections 524, such as those illustrated in FIGS. 8 and 9, to distribute the compression forces evenly across the foot while loading the pulley 528 with a biasing force that is between the minimum and maximum.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications, and departures from the embodiments, examples, and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear, comprising:

an upper attached to a sole structure to define an interior cavity, wherein the sole structure includes a forefoot region, a midfoot region, and a heel region; and a closure system, the closure system further comprising:

a closure mechanism;

a securing element; and a cord that is operably engaged with the upper of the footwear and the closure mechanism, wherein the closure mechanism is actuated to adjust the footwear from a loosened configuration to a tightened configuration, wherein the securing element is configured to be engaged with the closure mechanism to secure the footwear in the tightened configuration, and wherein the securing element is a strap that extends across the upper from a medial side to a lateral side, the strap having a receptacle defined by a securing surface, the securing surface being configured to be removably engaged with the closure mechanism, wherein the strap narrows in width from the lateral side to the medial side, such that the strap, when engaged with the closure mechanism, only partially covers a winding region formed by the cord proximate a tongue of the footwear, wherein the strap has a fixed end that is permanently fastened to the upper and the sole structure.

2. The article of footwear of claim 1, wherein the closure mechanism is mounted to the upper on the lateral side of the footwear within a heel region.

3. The article of footwear of claim 1, wherein the cord is operably engaged with the closure mechanism and extends through the winding region proximate the tongue.

4. The article of footwear of claim 1, wherein the securing element is configured to at least partially conceal the cord.

5. The article of footwear of claim 1, wherein the securing element is formed of an elastic material.

6. An article of footwear that has a closure system, the closure system comprising:

a closure mechanism disposed centrally on an upper and proximate a tongue of the footwear;

a securing element; and a cord that is operably coupled to the upper and the closure mechanism, wherein the securing element includes a first segment and a second segment that overlaps the first segment, wherein the closure mechanism is configured to be actuated to tighten and loosen the footwear, wherein at least a portion of a winding region proximate to the tongue remains exposed when the securing element is engaged with the closure mechanism, wherein the securing element is a strap having a receptacle defined by a securing surface, the securing surface being configured to be removably engaged with the closure mechanism, wherein the second segment of the securing element includes a free end that is configured to be articulated between an unfastened position where the second segment is spaced apart from the closure mechanism and a fastened position where the second segment is removably engaged with the closure mechanism, and wherein the first segment is engaged with the closure mechanism in both the fastened position and the unfastened position.

7. The article of footwear of claim 6, wherein the cord is laced through a plurality of eyelets on the upper and at least partially concealed by the securing element.

8. The article of footwear of claim 6, wherein the free end is disposed on a lateral side of the footwear.

9. An article of footwear that has a closure system, the closure system comprising:

a strap having a first segment and a second segment;

a band; and a plurality of retention features arranged on an upper, wherein the band is coupled to at least one of the retention features and to the strap, wherein the second segment of the strap is configured to be pulled to tighten the footwear, wherein the strap is wrapped around a heel end of the upper and extends from a lateral side to a medial side, wherein the second segment of the strap is configured to be removably fastened to the first segment of the strap, such that a free end of the second segment is coupled to the first segment on the lateral side of the footwear in a fastened position, and wherein the first segment of the strap includes a pulley attached to a first end, and pulling the free end of the strap causes the first end of the strap to slide along the upper.

10. The article of footwear of claim 9, wherein pulling the free end of the strap exerts a tensional force on the band, and wherein the band exerts a tensional force on the upper.

11. The article of footwear of claim 9, wherein the band is formed of an elastic material.

12. The article of footwear of claim 9, wherein a user may adjust a tightness of the footwear by adjusting the band relative to the retention features, the strap, or both.

* * * * *